US006132532A

United States Patent [19]

Shepelev et al.

[11] Patent Number: 6,132,532

[45] Date of Patent: Oct. 17, 2000

[54] ALUMINUM ALLOYS AND METHOD FOR THEIR PRODUCTION

[75] Inventors: Lyudmila Shepelev, Kiryat Ata, Israel; Pyotr Popel; Irina Bordrova, both of Ekaterinburg, Russian Federation; Vladimir Manov; Yuri Tarakanov, both of Haifa, Israel; Eliezer Adar, Sdei Varburg, Israel

[73] Assignee: Advanced Metal Technologies, Ltd., Even Yehuda, Israel

[21] Appl. No.: 09/006,034

[22] Filed: Jan. 12, 1998

[30] Foreign Application Priority Data

Jan. 13, 1997 [IL] Israel ..... 120001

[51] Int. Cl.[7] ..... B22D 27/08

[52] U.S. Cl. ..... 148/549; 148/558; 164/57.1; 164/58.1; 164/71.1

[58] Field of Search ..... 164/57.9, 58.1, 164/71.1, 900; 148/549, 558; 75/255; 419/26, 32

[56] References Cited

U.S. PATENT DOCUMENTS

| | | | |
|---|---|---|---|
| 4,373,950 | 2/1983 | Shingu et al. | 164/761 |
| 5,186,236 | 2/1993 | Gabathuler et al. | 164/71.1 |
| 5,193,605 | 3/1993 | Divecha et al. | 164/900 |
| 5,344,605 | 9/1994 | Kaji et al. | 419/31 |
| 5,484,492 | 1/1996 | Rogers et al. | 148/549 |
| 5,549,951 | 8/1996 | Yamaguchi et al. | 75/255 |
| 5,626,692 | 5/1997 | Rohatgi et al. | 148/549 |
| 5,730,198 | 3/1998 | Sircar | 148/549 |

FOREIGN PATENT DOCUMENTS

| | | | |
|---|---|---|---|
| 3126590 | 1/1983 | Germany | 164/71.1 |
| 839680 | 6/1981 | U.S.S.R. | 164/71.1 |

*Primary Examiner*—George Wyszomierski

*Attorney, Agent, or Firm*—Akin, Gump, Strauss, Hauer & Feld, L.L.P.

[57] ABSTRACT

A process for producing an Al—Si casting alloy. An alloy is heated to a first temperature to produce a melt and over heat it. A modifier is then added to the melt. The modifier includes an ultra disperse powder capable of remaining in a solid state during the entire alloy production process. The alloy is treated with ultrasound. The alloy is degassed or fluxed, and the melt is poured.

8 Claims, 4 Drawing Sheets

ALUMINUM ALLOYS AND METHOD FOR THEIR PRODUCTION

FIELD OF THE INVENTION

The present invention relates to aluminum-silicon alloys and a method for their production, and more particularly to alloys including an ultrafine powder as a modifier to achieve an alloy having improved properties.

BACKGROUND OF THE INVENTION

Heretofore, it has been difficult to use secondary aluminum-silicon alloys in industry, because of the unsatisfactory properties of these alloys. It would be desirable to use recycled alloys in various fields, for example the automotive industry, agriculture (i.e. tractors) and aviation. Recycling is a preferred alternative in industry, offering economic advantage as well as better use of natural resources. Another important benefit of recycling is the preservation of the environment, since it uses waste metals which would otherwise contaminate the environment, and present a problem to dispose of. Throughout the present disclosure, the term "silumin" is used to indicate an Al—Si alloy.

One problem, however, is that recycling usually results in secondary alloys, i.e., alloys which include more than about 0.5% impurities, like Fe, Mg, Cu, Cr, Ni, Zn, Mn and/or others.

Likewise, there are lower grade ores which result in secondary alloys. In many cases, the impurities include an enhanced percentage of iron Fe (for example, up to about 0.7%).

A problem exists not only with secondary alloys. Even a smaller percentage of the above impurities in Al—Si alloys may have a detrimental influence on the properties of the alloy.

The low performance relates to the casting and mechanical properties of these alloys, for example their castability, porosity, machinability, ductility and fatigue strength.

The undesirable properties of these secondary alloys mainly result from the structure into which these alloys solidify, with the iron content crystallizing into specific structures which include, for example, a long needle morphology, or Chinese script, or needles. Structures including these morphologies with their undesirable properties appear while cooling the alloy, for example in a sand cast, at cooling rates between about 0.1 and about 1.0 degrees K/second. Similar structures with these morphologies also appear in other casting methods.

Several known methods have been suggested in an attempt to partly remedy these problems.

It has been suggested that the problem of large iron-bearing constituents might be remedied by:

1. increasing the cooling rate,
2. reducing the iron content,
3. adding elements which transform the iron constituents into a harmless shape,
4. adding elements to the liquid, which dissolve the undesired phases into smaller parts.

It has been suggested that the undesired influence of silicon impurities might be reduced by:

1. increasing the cooling rate,
2. heat treating to dissolve or spherodize the compounds Increasing the cooling rate may be useful for both problems, but the required substantial increase in the cooling rate can only be achieved by changing to other casting methods, such as changing from sand casting to metallic mold casting, for example. These methods, however, tend to increase the internal tension in the casting, which may produce warping or cracking of the casting.

Metallic molds are very expensive, and are therefore not preferred over sand molds.

Moreover, changing to metallic molds requires a drastic change in the method of production, a costly alternative.

A reasonably efficient and effective known method is the addition of elements which transform the iron compound from relatively large plates or needles to smaller and less embrittling forms. The elements used, known as iron correctors, include manganese, chromium, nickel, cobalt, molybdenum and other elements.

These elements form compounds with the iron in the alloy, which crystallize into a phase with various forms like globular or dendritic forms, which do not have the undesired properties of the above-mentioned plates and needles.

Despite their deficiencies, in many cases the addition of iron correctors is chosen as a reasonable compromise.

These additional elements, however, add a significant amount to the cost of the alloy thus formed. Moreover, these additions influence the properties of the alloy. Thus, the percentage of iron-bearing compounds is increased to the point that they influence the solidification mode and reduce the fluidity of the alloy.

There is a complication in the manufacturing process, since the preparation of a master alloy is required. This makes the process more expensive. Master alloys are required since aluminum will not accept certain materials, molybdenum for instance.

Machinability, too, is reduced, especially if primary crystals of the compounds are formed.

As known in the art, the silicon phase can be present in several structures. The eutectic can be random, nonmodified, undermodified, modified and overmodified. The primary silicon crystals can appear as globular or plate-like shapes, as well as feathery, star shaped or spherodized.

If the alloy contains more than about 0.8% Fe, then primary Fe Si $Al_5$ crystals appear.

If Mn is also present in the alloy, then the compound $(Fe\ Mn)_3Si_2Al_{15}$ is formed. This compound has the shape of Chinese script, thus the embrittling effect of Fe Si $Al_5$ is eliminated.

One known method of refining microstructure grains and precipitates is ultrasonic treatment of liquid metals. Treating a metallic melt with ultrasound results in transition from dendrite to non dendrite structure.

If the total content of manganese plus iron in the alloy exceeds about 0.8%, then the $(Fe\ Mn)_3Si_2Al_{15}$ crystals are primary and they appear as hexagonal globules. These globules do not embrittle the alloy, but they reduce its machinability.

If the Cr or Ni are present in the alloy, the compounds $(CrFeMn)_xSi_yAl_z$ or $(NiFeMn)_xSi_yAl_x$ are formed, respectively.

A preferred method for decreasing the mean size of the iron-bearing precipitates of the eutectic origin includes the modification of the alloy structure by the introduction of small amounts of specific elements (modifiers). The idea is to achieve a more disperse structure of the eutectics and, as a result, to decrease the size of the eutectic iron-bearing inclusions which are comparable in size with eutectic phases.

All of the alkaline and most of the alkaline earth metals achieve the modification effect.

The most used metal is sodium, which is also the cheapest. Strontium is also widely used. The other alkaline earth metals are less effective. To achieve the desired modification effect, the percentage of the sodium addition should preferably be about 0.01–0.02%.

Because of the limited miscibility and the strong tendency of sodium to oxidize, however, larger amounts of sodium are added, especially if the melt is not poured immediately. Sodium is a difficult metal to handle. It tends to float on the melt and is preferably kept immersed until melted; it oxidizes rapidly and its effect disappears in a short time.

It is known that sodium decreases the grain size of the alloy. This is a desirable effect. Sodium, however, has an adverse effect on the castability of the melt. Sodium has no influence on the iron phase, and therefore is more useful for relatively clean alloys.

Modification can also be produced with alkaline metal salts if they decompose in contact with the melt, but the salts which are effective are very expensive and are not too efficient.

The elements which nucleate the silicon and distribute the primary silicon crystals include: arsenic, sulfur, selenium, tellurium and gallium plus tellurium. Boron together with titanium refines the grain size of the aluminum but does not appreciably affect the silicon appearance.

Small amounts of alkaline or alkaline earth metals or alkaline metal salts change drastically the appearance of the silicon crystals, which become smaller, more rounded and form a coupled eutectic. Basically, there are two processes which occur:

1. The eutectic changes from separated to coupled.
2. There is a decrease in the surface tension of aluminum, that leads to silicon particles which are more rounded and smaller.

Unfortunately, there is no transformation of the iron-bearing constituents, which retain their undesired shape.

One of the most efficient methods to decrease the volume fraction and the main size of the primary iron-bearing precipitates is sufficient overheating of the silumin melt, above liquidus. It was found that liquid Al—Si alloys conserve microheterogeneous state for a long duration after the ingot melting or components mixing at a temperature above liquidus. The microheterogeneity is inherited from the initial heterogeneous property of the material.

Just after their melting, fragments of various solid phases begin to dissolve. However, the dissolving process is not completed immediately, and no true solution is formed in the initial stage.

During a first stage, the melt has a colloidal structure, comprising an aluminum-bearing solvent and disperse (on the order of about 10 nm size) colloidal particles including silicon, iron and other elements. These particles either dissolve very slowly or remain in a metastable state of equilibrium with the surrounding melt.

In any case, at a temperature slightly above liquidus, the system conserves its microheterogeneity for a period on the order of about 10 hours, that is, during the whole melting process. When the melt is crystallized, the above-mentioned colloidal particles become the nuclei of solid silicon, iron and other element bearing phases. This may result in an alloy with inferior performance, as detailed above.

Further details regarding the above-described processes may be found, for example, in the following literature:

1. L. F. Mondolfo, "Aluminum Alloys: Structure and Properties". 1979 p. 971.
2. I. Minkoff, "Solidification and Cast Structure". 1986. John Wiley and Sons.
3. Naeker, "Proceedings of the Conference on Thermal Analysis of Molten Aluminum" 1985 p.155.
4. Zhao et al., "Effect of Zn on microstructure and properties of Al—Si alloy". Taiyuan Univ. of Technology/Journal of Special Casting & Nonferrous Alloys. 2 1994. pp. 5–7. Language: Chinese. The paper deals with the effect of Zn on the structure and properties of Al—Si alloy. Eutectic cell structure is formed in the modified alloy by the addition of certain Zn.
5. Chichko et al., "On the parameters of nucleation of modified and nonmodified silumin metals". Belorusskaya Cosudarstvennaya Politekhnicheskaya Akademiya, Minsk, Belorus. Rasplavy n 5 September–October 1993, pp 83–86. Language: Russian.
6. G. I. Eskin, "Ultrasonic Treatment of liquid Aluminum" Moscow, Metalurgia, 1982, pp. 232 (In Russian).
7. I. G. Brodova, P. S. Popel, "The physics of Metals and Metallography:, Moscow, Metalurgia, 65, 21, 1988 (In Russian).

Cooling curves are built for non-inoculated and Na-inoculated aluminum-11.5–12.5% silicon alloys. The nuclei number and growth rate are estimated as a function of temperature (35–125 degrees C.) for each curve by the program developed. The Kolmogorov model corrected for the heat balance equation.

Prior art patents which may have a relationship to the present invention include the following:

Langenbeck et al., U.S. Pat. No. 4,799,978, details an aluminum powder alloy having good high temperature performance—contains iron, nickel and chromium. Hot worked Al alloy powder article consists of (in %): al 81–91.9 esp. 86, Ni 4–8 esp. 6, Fe 4–8 esp. t and Cr 0.1–3 esp. 2. USE/ADVANTAGE—Especially in manufacture of aircraft parts exposed to elevated temperatures. Alloy retains its mechanical properties even after prolonged exposure to tempertures up to 800 deg. F.

Mahajan et al., U.S. Pat. No. 4,787,943, details a dispersion strengthened aluminum alloy—contains titanium and rare earth(s). Al alloy dispersion-strengthened with rare earth metal(s) comprises (in wt. %): Ti 2–6, rare earth(s) 3–11, (VIII) element(s) 3 max and Al the balance. Pref. rare earth is Gd. Pref. max. at ratio of Ti to rare earth is about 2:1. The amount of (VIII) element is 0.1–3.0 wt. % and the preferred element is Fe. A specific alloy has the composition Al-4Ti-4Gd. In a typical process, 75 micron thick ribbon is formed by casting onto a chill wheel and annealing at 100–600 deg.C. for about 1 hr.

Schuster et al., WO 8706624, U.S. Pat. No. 4,786,467, details a cast metallic matrix with refractory reinforcement with good stiffness obtained by mixing melt without gas entrainment using shearing action. In the production of a composite material comprising an alloy reinforced with particulate non-metallic refractory the latter is mixed with the molten matrix under such conditions that introduction and retention of gas are minimized, and that the particles do not degrade in the mixing time. In mixing the particles and melt are sheared past each other to promote wetting. The mixture is then cast at such a temperature that no solid metal is present. Preferably the matrix phase is an aluminum alloy and the reinforcing phase is silicon carbide, alumina, boron carbide, boron nitride or silicon nitride.

Kubo et al., EP 241198, JP 62240727, U.S. Pat. No. 4,789,605, details a light metal matrix composite material with good high temperature properties—having reinforcing phase including potassium titanate whiskers. A composite material comprises a matrix of light metal reinforced with a mixture of potassium titanate whiskers and short fibre material selected from silicon carbide or nitride whiskers, alumina short fibers, crystalline or amorphous alumina-silica short fibers. The overall proportion of reinforcing phase is 5 to 50 vol. %, and the proportion of titanate whiskers in that phase is 10 to 80 vol. %. Preferably the proportion of reinforcing phase is 10–40% and the proportion of titanate in it is 20–60%.

None of the above-mentioned patents or literature appear to disclose or suggest an approach comprising both modification and overheating. The inventors are aware of patents using sodium, but are not aware of any patent which discloses or suggests the use of strontium.

Recycling of metals is highly desirable in the automotive industry, as well as in agriculture (i.e. tractors) and aviation. A problem with recycling is that it usually results in secondary aluminum-silicon alloys, that is alloys which include impurities such as Fe, Mg, Cu, Zn, Cr, Mn and/or Ni and others. These secondary alloys have unsatisfactory properties, for example mechanical properties and poor castability, as well as unsatisfactory heat resistance and other properties.

These unsatisfactory properties mainly stem from the structure into which these alloys solidify, for example Fe precipitating into long needles, plates or skeleton morphology shapes (about 100 micrometers long). Prior art solutions to the iron-rich precipitates include the addition of elements known as "iron correctors". These additives include manganese, chromium, nickel, cobalt, molybdenum and others. They form compounds with the iron in the alloy, which crystallize into various forms that do not have the above-mentioned undesired properties of the prior plate or needle structures. For example, if Mn is introduced into the alloy, then the compound $(FeMn)_xSi_yAl_z$ is formed, which compound has the shape of Chinese script (skeletons), thus eliminating the embrittling effect of $FeSiAl_5$.

The above additional elements, however, significantly increase the cost of the alloy. Moreover, other properties are detrimentally affected, including a reduction in the fluidity of the alloy, and a reduction in machinability. It is known that sodium is a good modifier, however it has a detrimental effect on castability.

SUMMARY OF THE INVENTION

In accordance with the present invention, these and other objectives are achieved by providing a method for the production of Al—Si casting alloys. The method improves the properties of Al—Si alloys, and is especially useful for alloys with impurities, alloys which at present have inferior mechanical properties, for example secondary Al—Si alloys. The term secondary alloy usually refers to an alloy which includes more than about 0.5% impurities like Fe, Mg, Cu, Cr, Ni and others. The resulting secondary Al—Si alloy (or silumin) has improved properties, as detailed below.

According to one aspect of the present invention, in a preferred embodiment, the alloys include modifiers in the form of ultrafine powders, which remain in solid state in the melt and form the nuclei around which iron solidifies into forms having the desired properties. Throughout the present disclosure, the term "powders" refers to ultrafine powders.

According to a second aspect of the present invention, in a preferred embodiment, the modifiers are ultra disperse powders made of TiN or AlN, which materials it was found to result in the alloys with the desired properties. Other powders for example carbides and/or nitrides and/or carbonitrides can act as nucleant for the iron phases.

According to a third aspect of the present invention, in a preferred embodiment, the method of production of the alloy includes the process of overheating the melt above the homogenization temperature, prior to casting.

According to a fourth aspect of the present invention, in a preferred embodiment, the method of production of the alloy includes a combination of overheating the liquid melt and the addition of the modifier powder prior to casting.

According to a fifth aspect of the present invention, in a preferred embodiment, the powder may be added to the melt either directly or within a master alloy. The preparation of a master alloy is preferred where the powder has a specific density which is different than that of the melt.

A master alloy preferably also contains Al, Mg and/or Cu, in addition to the ultrafine powder.

According to a sixth aspect of the present invention, in a preferred embodiment, the preferred concentration of modifier (by weight) should preferably represent about 0.01% to 0.019% of the mass of the melt.

According to a seventh aspect of the present invention, in a preferred embodiment, the method includes overheating, modifier addition and casting.

According to an eighth aspect of the present invention, in a preferred embodiment, the method includes the ultrasonic treatment of a melt, addition of a modifier, and casting.

According to a ninth aspect of the present invention, in a preferred embodiment, the method of production of the alloy includes a process of addition of a modifier powder, ultrasonic treatment, and casting.

Further objects, advantages and other features of the present invention will be apparent to those skilled in the art upon reading the disclosure set forth herein.

BRIEF DESCRIPTION OF THE DRAWINGS

A detailed description of a preferred embodiment of the present invention will be made with reference to the accompanying drawings.

DETAILED DESCRIPTION OF THE PREFERRED EMBODIMENTS

Figure 1:
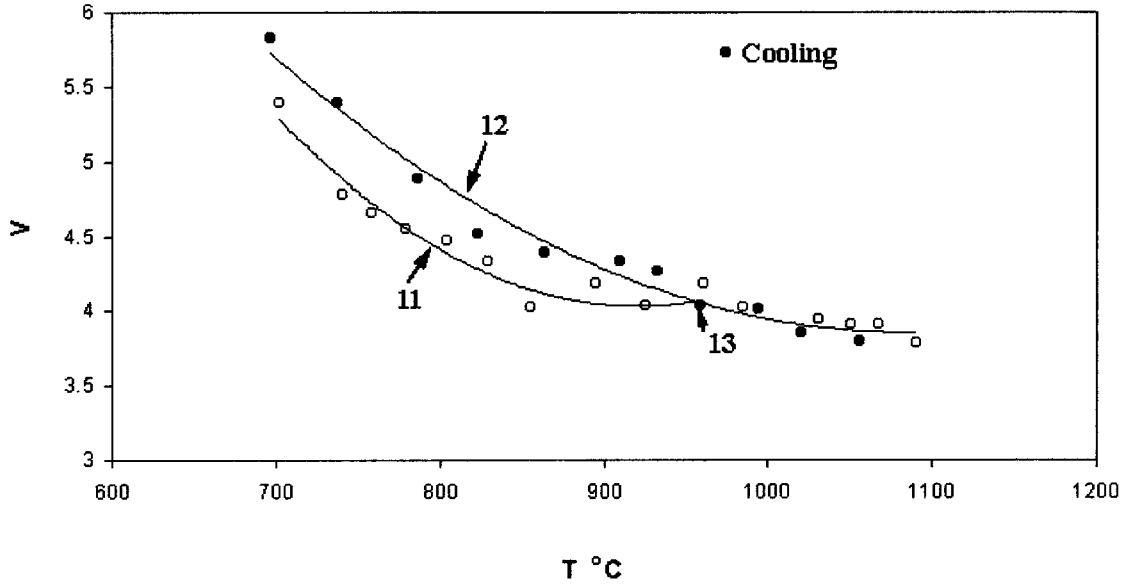
FIG. 1 illustrates an example of the temperature dependence for the viscosity of liquid silumin, during the heating stage and the subsequent cooling stage.

The following detailed description is of the best presently contemplated mode of carrying out the invention. This description is not to be taken in a limiting sense, but is made merely for the purpose of illustrating the general principles of the invention. The scope of the invention is best defined by the appended claims.

In a preferred embodiment, the present invention comprises Al—Si casting alloys and methods for their production using modification with an ultrafine powder. The methods improve the properties of silumin alloys with impurities, and are especially suitable for secondary alloys.

One preferred method for producing an Al—Si casting alloy comprises the following steps:

1. heating the alloy to a temperature which is about Delta_T degrees C. above the liquidus temperature;

2. adding a modifier comprising an ultra disperse powder capable of remaining in solid state during all stages of the alloy preparation process;
3. degassing (or fluxing) of the alloy; and
4. pouring the melt.

Another preferred method for producing an Al—Si alloy comprises the following steps:

1. heating an alloy to a first temperature to produce a melt, the alloy having a liquidus temperature and the first temperature being about Delta_T degrees C. above the liquidus temperature;
2. treating the melt with ultrasound for not less than about one minute;
3. adding a modifier to the melt, the modifier comprising an ultra disperse powder capable of remaining in a solid state during the process for producing the Al—Si casting alloy;
4. performing at least one of the steps of degassing and fluxing the alloy; and
5. pouring the melt.

To achieve the desired properties, the modification should preferably conform to the following conditions:

1. The lattice conformity between alpha-Al and the powder nuclei;
2. Synthetic crystals should preferably be provided, which can be successfully added to the liquid silumin, either directly or contained in a master alloy;
3. The pulverized powder should preferably be a stable phase within liquid silumin, including at the elevated overheating temperature;
4. A sufficient dispersiveness of the powders should preferably be achieved, so that nuclei to iron-bearing constituents be dispersed throughout the melt.

According to the present invention, in a preferred embodiment, it was found that the addition of synthetic titanium nitride (TiN) powder to the liquid silumin having an enhanced iron content results in an alloy with improved properties. TiN is a stable phase in the liquid silumin, prior to casting.

Thus, TiN powder particles each become a center of crystallization for phases which contain iron Fe, and it reduces the iron phases to fragments.

For example, in an alloy containing 6.98% Si, 1.2% Fe, 0.35% Mg, 0.31% Mn and other impurities, it was found that the needles in the initial aluminum alloy were about 50 to 150 microns long.

After the addition of a modifier powder (with the nucleation process), it was found that the length of needles in the alloy is about 20–70 microns, the smaller length corresponding to improved mechanical properties.

Moreover, limiting the silicon plates growth by TiN leads to change of eutectics kind based on silicon.

The use of synthetic powders as nuclei for secondary aluminum alloys is one novel aspect of the present invention.

TiN is just one of many types of ultra disperse powders which may be used as nucleation centers in silumin alloys. Other powders may be made of AlN, carbides and/or nitrides and/or carbonitrides, for example. It is also possible to use a mixture of the above powders, to achieve still better performance.

These powders are capable of acting as nucleant for the iron phases. It was found that materials with a cubic lattice form are suitable as nucleants. Some materials with hexagonal lattice may be suitable as well.

These powders remain in solid state in the melt at the liquid temperature. If an overheating process is used and the modification is made prior to overheating, then the powders should preferably remain solid even at the overheating temperature. Overheating temperatures may be about 1100 degrees Celsius, or 1200 degrees, or up to 1400 degrees, according to the specific composition of the alloy.

Heterogeneous nucleation can be regarded as a geometrically modified case of homogenous nucleation by which the activation barrier is decreased by the presence of a foreign substrate. A calculation from the geometrical point of view shows that, when the liquid/solid interface of the substance is partly replaced by an area of low energy solid/solid interface between the crystal and a foreign solid, then nucleation can be greatly facilitated.

Normally, the potential of the foreign substrate in facilitating the nucleation process may be estimated from the following equation:

$$f(Q)=(2+\cos(Q))(1-\cos(Q))/4$$

where Q is the wetting angle between the growing crystal and the foreign substrate within the melt. Under conditions of good solid/solid wetting (that is, small Q), the foreign substrate can have a dramatic effect on the nucleation process.

Thus, the silumin alloys include modifiers in the form of ultrafine powders, which remain in solid state in the melt and form the nuclei around which iron solidifies into forms having the desired properties.

Accordingly, pulverized powder of TiN may be used as a modifier. An ultra disperse powder TiN was used, of dimensions 20 to 80 nm (nanometers). It was found that, as the size of the powder particles is smaller, the properties of the resulting alloy are better. Thus, it is preferable to use smaller size particles. The powder size detailed above corresponds to presently available powders. As smaller powders become available (for example in the 10 nm range) it is recommended to use these finer powders where improved performance is required.

This is a synthetic powder of cubic crystalline shape.

The TiN used has a lattice parameter of a=4.24173 (space group Fm3m) while the lattice parameter of aluminum decreases linearly, to reach a value of a=4.478 E-10 meter at 1% Si and a=4.0365E-10 meter at 11%.

The TiN powder modifier, in the form of a master alloy, was introduced into the silumin melt at a temperature of 720 to 750 degrees C. The temperature is determined from the phases diagram (Al—Si), and varies according to the relative percentage of Si. In the following description, where a specific temperature is mentioned for clarity, it is to be understood that it is the temperature derived as above detailed.

The composition of the master alloy included 7% TiN, 7% Mg and 86% Al.

It was found that good performance is achieved with master alloys including about x % of Mg or Cu or a combination thereof, and about x % of TiN powder, with the rest Al, and wherein x is in the range about 3 to 9 percent. In other embodiments, still better results were achieved using a master alloy with x about 7 percent.

In other experiments, it was found that the desirable alloy properties were achieved with the addition of the modifier into the alloy at temperature of about 720 and up to 1000 degrees C.

According to the present invention, in a preferred embodiment, it was found that overheating the melt prior to casting may be used to further improve the properties of the alloy. A possible cause of an alloy with inferior performance may be the colloidal structure of the melt, comprising an aluminum-bearing solvent and disperse (of the order of 10 nm size) colloidal particles including silicon, iron and other elements.

At a temperature slightly above liquidus, the system conserves its microheterogeneity for a period on the order of about 10 hours, that is during the whole melting process. When the melt is crystallized, the above-mentioned colloidal particles become the nuclei of solid silicon, iron and other element bearing phases.

Scientists at AMT Ltd. have found that the microheterogeneous state of liquid silumin can be irreversibly destroyed by overheating the melt to a higher temperature above liquidus.

To achieve this effect, the silumin alloy is heated to a temperature of about 1000 degrees C. and kept at that temperature for a predefined time period, for example more than about 10 minutes.

The specific temperature of overheating depends on the composition of the melt. The overheating process transforms the melt to a true solution.

One method of silumin production may thus include the following steps:

1. Heating the silumin alloy to a temperature Tp which is Delta_T degrees C. above the liquidus temperature. It was found that Delta_T in the range of about 20 to 40 degrees C. achieves the desired effect. The preferred Delta_T depends on the specific composition of each alloy being considered. Usually, the temperature is in the range of about 720 to 750 degrees C. Tp refers to the pouring temperature of the melt.
2. Adding the modifier, the ultra disperse powder TiN, of dimensions of about 10 to 80 nm (nanometer). In a preferred embodiment, the quantity of powder is within the range about 0.01% to 0.019% of the melt, by weight.
3. Overheating the melt to about 1000 degrees, and keeping the alloy at that temperature for about 20 minutes. The required overheating temperature depends on the structure of the alloy, and may range between about 1000 and 1400 degrees C. This is a temperature where the melt becomes homogeneous.
4. Cooling the melt back to the pouring temperature Tp, for example about 750 degrees C., or a value suitable for that specific alloy.
5. Degassing (or fluxing) using a procedure known in the art, for example using Ar or salts.
6. Pouring the melt. A sand cast is preferably used.

The melt should preferably be overheated above its homogenization temperature (or above the temperature of its property-temperature dependence branching), and the alloy kept at that temperature for about 20–30 minutes. This achieves a homogenous alloy.

For best results, while using sand casting the following points should preferably be watched: gas content, grain refinement and modification of the aluminum silicon alloys.

In another embodiment of the present invention, the method of production includes steps 1–5 as detailed above, but in a modified order:

1. Overheating the melt to about 1000 degrees, and keeping the alloy at that temperature for about 20 minutes. Again, the exact temperature depends on the specific alloy, and may be between about 1000 to 1400 degrees C.
2. Cooling the melt back to about 720–750 degrees (to a temperature suitable to the specific alloy being processed, herein referred to as the pouring temperature Tp).
3. Degassing (or fluxing) using a procedure known in the art, for example using salts or Ar.
4. Adding the modifier, the ultra disperse powder TiN, of dimensions of 10 to 80 nm (nanometer), in a quantity within the range about 0.01% to 0.019% of the melt, by weight.
5. Pouring the melt into a sand cast.

This method was also found to achieve good results.

The above methods were found to give satisfactory results with sand casting, which is the usual, low cost method in use.

Thus, more complex methods, which also create new problems as detailed above, are avoided.

It was found that, since the TiN powder has a specific density which is different than that of the silumin, that a master alloy is required. Thus, it is recommended that TiN be added as a master alloy, rather than directly as a powder. This ensures that the powder will be uniformly dispersed in the liquid alloy, to achieve a generally uniform casting with the desired properties.

In other powders, like AlN, which have a specific density similar to that of the silumin, no master alloy is required, and the powder may be added directly to the melt. According to this embodiment of the invention, the powder was not added directly, but was encapsulated in a piece of aluminum foil. Thus an ampule was obtained. This structure ensures the powder will penetrate into the melt, and the foil will dissolve in the aluminum alloy with no impurities added.

Other ultra disperse powders may be used as modifiers, for example carbides or nitrides or carbonitrides, having dimensions in the range of about 0.01 to 0.08 microns.

In another embodiment of the invention, a mixture of powders is used for still higher performance. Thus, the modifier powder comprises a combination of ultra disperse powder of AlN and/or TiN and/or carbides and/or nitrides and/or carbonitrides, each powder having dimensions in the range of about 0.01 to 0.08 microns.

The methods II and III detailed below were found to achieve alloys with superior performance. Method IV also achieves good performance. Comparative tests were performed on alloys prepared using a novel casting method in accordance with the present invention, whose performance was evaluated against alloys prepared according to the prior art casting method, as detailed below.

For the experiments performed to test the preferred embodiments of the present invention, an aluminum casting alloy was prepared including: 6.98% Si, 1.12% Fe, 0.35% Mg, 0.31% Mn, 0.18% Cu, 0.03% Cr, 0.17% Ti, 0.36% Zn, 0.01% Ni. This is but one example of secondary aluminum alloy compositions which can be improved according to the present invention.

Casting Method I (Prior Art)

The method includes the following steps:

A. Heating the alloy to about 720 degrees C.

B. degassing for 10 minutes

C. casting in a dry-sand mold

Casting Method II (Preferred Embodiment)

The method includes the following steps:

A. Heating the alloy to the overheating temperature, Toh. In the tests performed at AMT Ltd., Toh was about 1100 degrees Celsius;

B. holding for about 30 minutes;

C. cooling the melt together with the furnace, to the pouring temperature Tp. In tests performed at AMT Ltd., Tp was about 720 degrees Celsius;

D. degassing for about 10 min.;

E. addition of TiN powder within a master alloy to the melt, about 0.015% powder by weight;

F. holding for about 3 min., while mixing the melt;

G. casting into a dry-sand mold.

Degassing was performed using hexachlorethane as known in the art. Other degassing materials may be used, for example argon.

A synthetic titanium nitride TiN ultra disperse powder was used, with dimensions of about 20 to 70 nanometer, to prepare the master alloy. The powder within the master alloy was added directly into the liquid aluminum alloy at the pouring temperature Tp of about 720–730 deg. C.

Casting Method III (Preferred Embodiment)

The method includes the following steps:

A. Heating the alloy to the overheating temperature, Toh. In the tests performed at AMT, Toh was about 1100 degrees Celsius;

B. holding for about 30 min.;

C. cooling the melt together with the furnace, to the pouring temperature Tp. In tests performed at AMT Ltd., Tp was about 720 degrees Celsius;

D. degassing for about 10 min.;

E. addition of AlN powder to the melt, about 0.015% powder by weight;

F. holding for about 3 min., with mixing of the melt;

G. casting into a dry-sand mold.

A synthetic aluminum nitride AlN ultra disperse powder was used, with dimensions of about 20 to 70 nanometer. The powder was added directly into the liquid aluminum alloy at the pouring temperature Tp of about 720 deg. C.

Casting Method IV (Preferred Embodiment)

The method includes the following steps:

A. Heating the alloy to the overheating temperature, Toh. In the tests performed at AMT, Toh was about 1100 degrees Celsius.

B. holding for about 30 min.

C. cooling the melt together with the furnace, to the pouring temperature Tp. In tests performed at AMT Ltd., Tp was about 720 degrees Celsius.

D. degassing for about 10 min.

E. addition of a mixture of TiN powder and AlN powder to the melt, about 0.015% total powder by weight F. holding for about 3 min. with continuous mixing of the melt G. casting into a dry-sand mold Test Methodology and Results The microstructure and composition of the specimens were evaluated by optical microscopy and Scanning Electron Microscopy (SEM) equipped with the Energy Dispersive Spectroscopy (EDS). (Link Oxford) was mounted on the SEM. SEM was conducted on a JEOL 840SEM. The same specimen was used for micro hardness testing routinely operated at 10 kV and 20 kV.

TEM was conducted on a JEOL 2000FX, routinely operated at 200 kV. The 2000FX also includes a link EDS system which was used for micro-elemental analysis.

The initial aluminum-silicon alloy was prepared from ingots by prior art casting method I. The alloy used included Al, about 13% Si, 1.09% Fe and other impurities.

The random eutectic globular primary silicon, elongated phases of $(CrFe)_4 Si_4 Al_3$ and $FeNiAl_g$, primary crystals of $(FeMn)_3Si_2Al_{15}$, the $(Cu, Ni)_2Al_3$ phase in the form of Chinese script and small needles, small quantities of $FeSiAl_5$ and $(CuNi)_2Al_3$ light small scripts) were clearly visible on the surface of the solid. The size of these structural compounds are presented in Table 1. The E.G. initial Vickers hardness of the matrix was found to be about 86.8.

The modified aluminum-silicon alloys according to the present invention were prepared from ingots by casting methods II and III.

The finely dispersed eutectic and dispersed silicon were clearly visible in both cases of modification.

For ingots prepared according to method II, the TiN powder particles acted as nucleation centers for the iron-containing phases such as $(CrFe)_4Si_4 Al_{13}$, $FeNiAl_9$, $(FeMn)_3Si_2Al_{15}$ and $FeSiAl_5$. As a result, those phases were fragmented. In addition, after overheating, a redistribution of Fe, Cr, Ni and Mn in these phases was observed. Thus, TiN powder is believed to act primarily as a nucleant.

Whereas the initial Vickers hardness of the matrix (method I) was about 70, the modified alloy with titanium nitride (method II) had an improved hardness of about 105.5.

For ingots prepared according to method III, the AlN powder particles acted as modificant and nucleation centers mainly for the aluminum matrix. The iron-enriched phases were found to be located on the grain boundaries of the typically modified alpha-Al phase.

A redistribution of Cu, Mg, Fe, Si, Zn, Mn, Cr and Ni as a result of overheating and modification with AlN powder was observed.

Whereas the initial Vickers hardness of the matrix (method I) was about 70, the modified alloy with aluminum nitride (method III) had an improved hardness of about 103.9.

Table 1 details the size of the various phases after casting using the methods I, II and III. The improvement (the decrease in size of these phases) is evident.

TABLE 1

The size of the various phases in the cast (for Al alloy with 13.1% Si and other impurities)

| | Size, micrometer | | |
|---|---|---|---|
| Phase | Method I Prior art | Method II Novel, TiN | Method II Novel, AlN |
| Si | 10–30 (globular) 40–60 (eutectic) | 5–10 (eutectic) | 5–10 (eutectic) |
| $(CrFe)_4Si_4Al_{13}$ | 40–120 | 10–40 | 30–80 |
| $FeNiAl_9$ | 40–60 | 5–25 | 15–25 |
| $(FeMn)_3Si_2Al_{15}$ | 60–80 | 25–35 | 40–45 |
| $FeSiAl_5$ | 25–30 | 10–15 | 20–25 |
| $CuSi_4Mg_8Al_4$ | 20–60 | 25–60 | 25–60 |
| $(CuNi)_2Al_3$ | 25 | 25 | 25 |

Thus, it was found that both methods II and III improved the castability of the melt by about 17%. The improved castability was measured using a castability test with castability test molds as known in the art.

Therefore, the above detailed methods can be applied for recycling of silumines with impurities. The methods may be also applied to eutectic, hypoeutectic and/or hypereutectic secondary silumines. According to the present invention, in a preferred embodiment, synthetic AlN or other powders with a specific density similar to that of silumin may be added directly to the liquid silumin, to achieve an alloy with a fine microstructure.

If a synthetic powder having a specific density which is different from that of silumin is used, for example TiN, then it is recommended that first a master alloy be prepared. The master alloy may then be added to the liquid silumin, to achieve an alloy having a fine microstructure.

In either case, this results in fine iron-enriched phases, finely dispersed eutectic and dispersed silicon.

Various embodiments of the present invention are possible.

For example, although the preferred quantity of the TiN and/or AlN powder to be added to the melt is about 0.015% powder by weight, it is possible to add powder in the range 0.012% to 1% by weight to achieve the desired above detailed effects.

A mixture of AlN powder and TiN powder according to the above detailed method IV may be advantageous for achieving still smaller size phases. It appears that the two powders may have different effects, the TiN acting more as nucleant for the Fe phases, whereas the AlN acts more as a modifier and nucleant for the aluminum phases. Thus, a synergetic effect may be achieved by using a mixture of the two powders, with respect to the size of the phases.

Where the castability properties are more important, then the TiN powder alone may achieve better results.

The preferred size of the TiN and/or AlN powder addition is between about 10 and 80 nanometer, that is 0.01 to 0.08 microns. The smaller the size of the powder, the better the properties of the alloy. Smaller size powders, however, demand a higher cost. Therefore, there is a tradeoff between cost of additive and the resulting properties of the silumin alloy. The minimum size, 20 nanometer, is the finest powder which is commercially available. When finer powders become available, it is recommended to use them for improved performance. Powder larger than 80 nanometer is not as effective as nucleant/modifier.

The pouring temperature Tp was about 720 degrees Celsius during tests performed at AMT Ltd. It is possible to hold at higher or lower temperatures. A pouring temperature Tp in the range 700 to 740 degrees Celsius is preferred, and according to the composition of the alloy.

The AlN and/or TiN powder are preferably added to the melt after overheating and reducing the temperature to about 720 to 740 degrees C.

Whereas the melt is heterogeneous prior to overheating, it becomes homogeneous as a result of overheating. It is better to add the powder to the homogeneous melt. Still, it is possible to add the powder prior to or during overheating. The powder is not affected by overheating.

The powder may also be added to the alloy in a process which does not include overheating at all. In this case, however, inferior results are to be expected. The alloy remains microheterogeneous, with a colloidal structure including aluminum-bearing solvent and disperse (size of about 10 nm) colloidal particles enriched with silicon, iron and other elements. These particles either dissolve very slowly or achieve a metastable equilibrium with the surrounding melt. In any case, at temperatures slightly above liquefaction, the melt may conserve its microheterogeneity for a time of about 10 hours, that is for all practical purposes during the whole period of the melting process.

When the above detailed microheterogeneous melt solidifies, the colloidal particles therein become the nuclei of solid silicon phases as well as iron and other element-bearing phases, resulting in inferior properties.

The abovementioned microheterogeneous structure of liquid silumin can be irreversibly destroyed by overheating, as detailed with reference to methods II, III and IV above. Thus overheating achieves a true solution, in which the TiN and/or AlN powders act effectively to achieve the desired properties, including machinability and castability inter alia.

It was found that, even without the addition of the powder, overheating improves the properties of the alloy. Thus, two sets of samples were cast at the cooling rate of 1 K/s corresponding to sand cast. The first set was heated in liquid state up to 700 degrees C. and cast at the same temperature. The second set was overheated to up to 1100 degrees C. (the temperature depends on the composition of the alloy) for about 20 to 30 minutes, then cooled down to 720 degrees C. for an eutectic alloy, and was cast at the same temperature.

The measured hardness of the first and second sets was found to be 770 and 970 MPa respectively. Thus, overheating of the melt results in an increase of the micro hardness of the alpha-dendrites.

Moreover, it was found that overheating reduces the volume percent of iron-bearing alumides by 25–30%, and the average size of the alumides decreases down to about 8–10 microns.

The exact temperature of overheating Toh depends on the structure of the silumin alloy. For a given batch of silumin, it is possible to perform tests on samples of the alloy to determine the required overheating temperature Toh. The overheating temperature Toh is also referred in the present application as the homogenizing temperature.

According to the present invention, in a preferred embodiment, the tests include continuous measurement (or taking samples at specific intervals) of the viscosity-temperature dependence and/or the density-temperature dependence of the liquid silumin, during heating and subsequent cooling.

It was found that, as the molten alloy achieves the required overheating temperature Toh and the microheterogeneous structure of liquid silumin is irreversibly destroyed, the properties of the alloy change accordingly. Thus, the properties of the alloy prior to reaching Toh and after reaching it are different. These findings are used in a method, according to the present invention, in a preferred embodiment, to determine the homogenizing temperature Toh, as follows.

Measurement of Homogenizing Temperature Toh. Method V

A. Heating the silumin alloy to well above 1000 degrees Celsius, while measuring and recording the viscosity of the melt vs. temperature. Measurements are taken either continuously or as a set of samples.

B. cooling the silumin alloy down, while continuing the process of measuring and recording the viscosity of the melt vs. temperature.

C. finding the divergence temperature, that is the temperature where the graph for the heating stage (step A above) departs or branches off from the graph for the cooling stage (step B above). The divergence temperature is the minimum value for the homogenizing temperature, or the overheating temperature Toh to be applied during the overheating process.

FIG. 1 illustrates an example of the temperature dependence for the viscosity of the liquid silumin, with graph 11 indicating viscosity during the heating stage and graph 12 indicating viscosity during the subsequent cooling stage. The solid circles indicate the cooling stage.

This corresponds to an Al alloy with 6.7% Si and impurities. One can see the splitting of the graphs at about point 13 in the graph, at about 940 deg. C. Thus, an overheating temperature slightly above this value should preferably be used.

Measurement of Homogenizing Temperature Toh. Method VI

A. Heating the silumin alloy to well above 1000 degrees Celsius, while measuring and recording the density of the melt vs. temperature. Measurements are taken either continuously or as a set of samples;

B. cooling the silumin alloy down, while continuing the process of measuring and recording the density of the melt vs. temperature;

C. finding the divergence temperature, that is the temperature where the graph for the heating stage (step A above) departs or branches off from the graph for the cooling stage (step B above). The divergence temperature is the minimum value for the homogenizing temperature, or the overheating temperature Toh to be applied during the overheating process.

Figure 2:
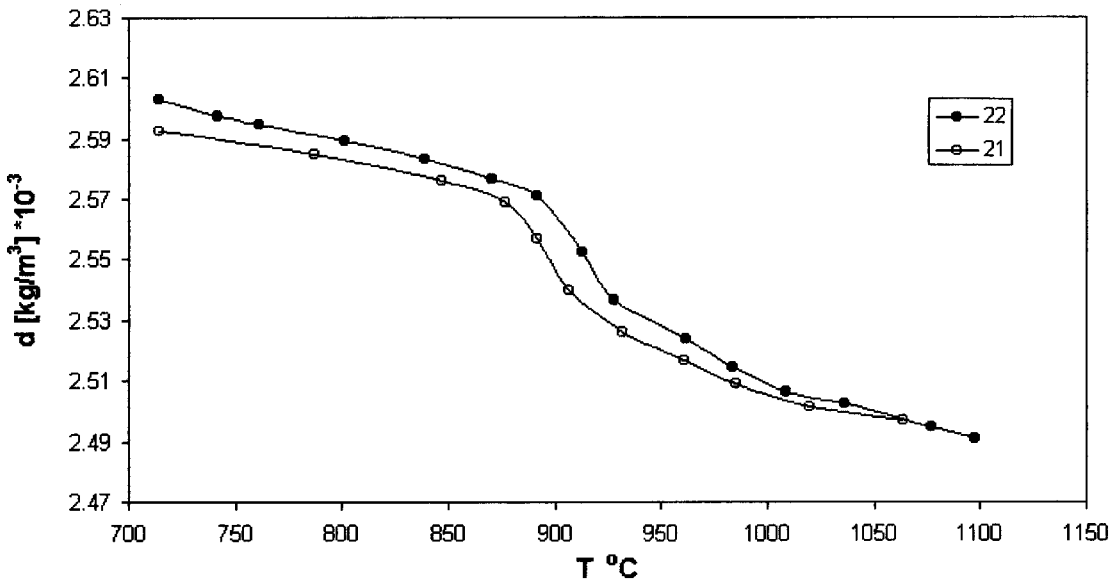
FIG. 2 illustrates an example of the temperature dependence for the density of liquid silumin, during the heating stage and the subsequent cooling stage.

FIG. 2 illustrates an example of the temperature dependence for the density of the liquid silumin (Al—13.1% Si and impurities), with graph 21 indicating density during the heating stage and graph 22 indicating the density during the subsequent cooling stage.

One can see the splitting of the graphs at about point 23 in the graph, corresponding to a temperature of about 1000 deg. C. A different temperature value may be found in other experiments, according to the composition of the alloy.

It is possible to use a combination of the above methods V and VI, for example taking the maximum value of temperature Toh, from the results found using the two methods, method V and method VI.

Thus, an overheating temperature Toh of slightly above 1000 deg. C. is recommended for this alloy.

Therefore, for the specific alloy under test in the presented example, the complete transition from a microheterogeneous melt transition to a true solution state is achieved at a temperature slightly above 1000 deg. C. The chemical analysis indicates that the alloy composition stays unchanged after the melt overheating in frames of the analysis precision.

Thus, the present invention includes the use of modifiers in the form of ultrafine powders. The materials may have a specific density similar to that of the silumin alloy to be improved, in which case the powder may be added directly to the melt. Otherwise, that is in case the specific densities are dissimilar, then a master alloy is preferably prepared, then is added to the melt.

The present invention suggests the following criteria for selection of materials for powders:

1. The material should preferably have a cubic crystalline structure. However, some materials with hexagonal structure are suitable as well. Suitable powders include TiN or AlN or materials containing carbides and/or nitrides and/or carbonitrides.
2. The materials should preferably have the capability to act as nucleant for the iron phases.
3. In case overheating is used and modification takes place prior to overheating, the material used should preferably be capable of remaining in solid state at the overheating temperature, that is in the range of about 1000 to 1400 deg. C., depending on the specific silumin alloy.

Figure 3:
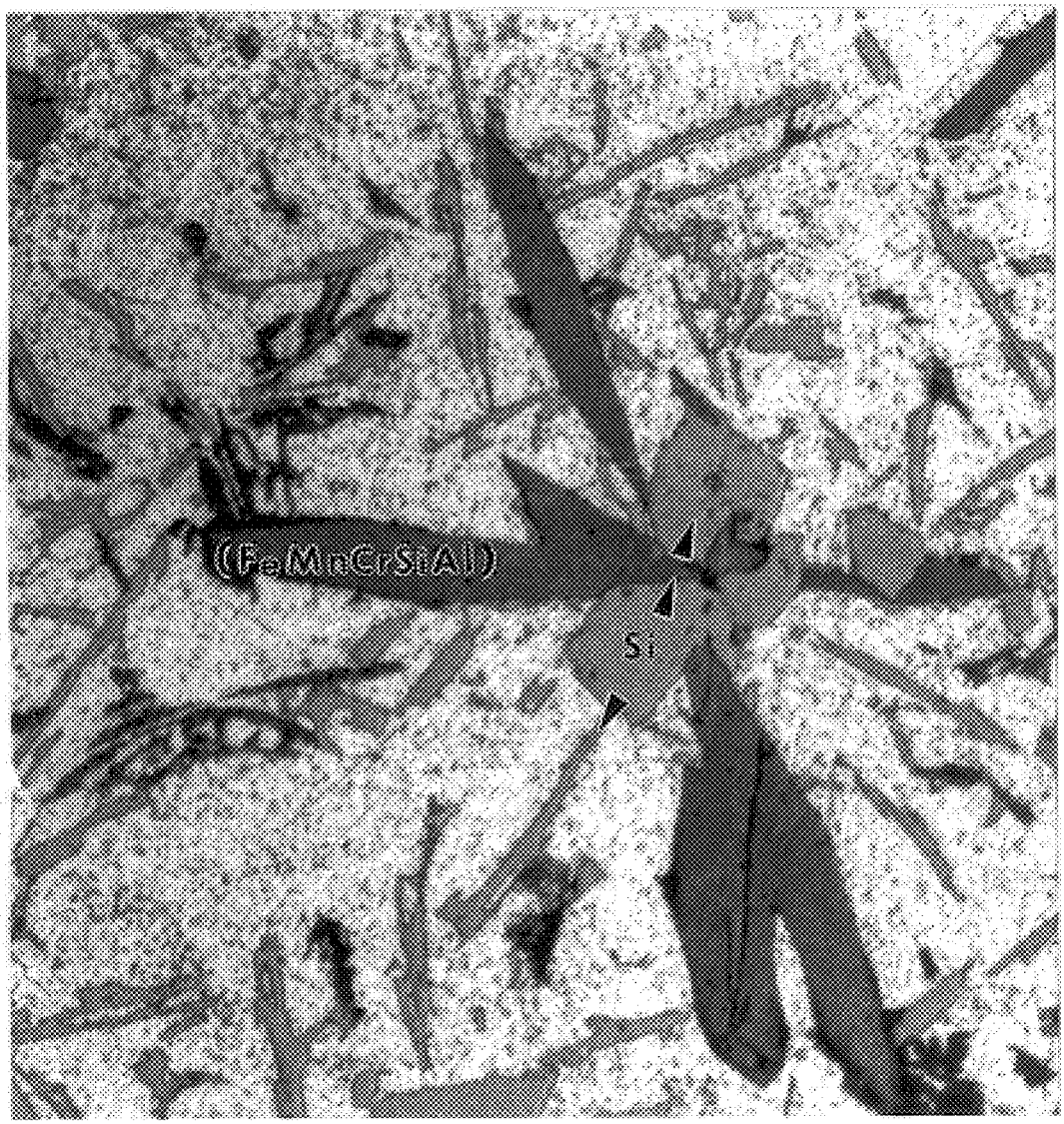
FIG. 3 is a photograph illustrating an example of a microstructure in a prior art secondary alloy.
Figure 4:
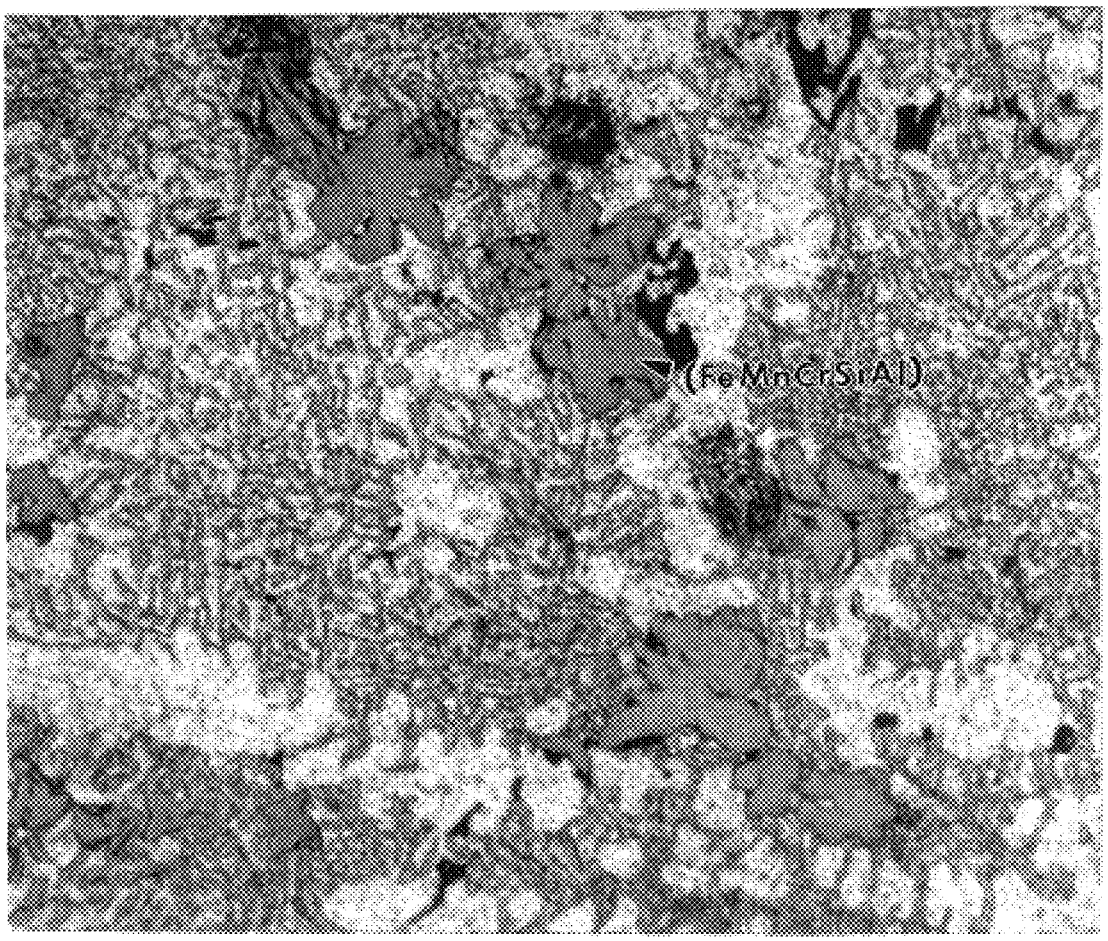
FIG. 4 is a photograph illustrating an example of a microstructure in an alloy made in accordance with the present invention.

To illustrate some of the improvements achieved using methods in accordance with the present invention, in its preferred embodiments, comparative photographs are presented. FIG. 3 is a photograph illustrating an example of the phases in a prior art secondary alloy. FIG. 4 is a photograph illustrating an example of the phases in an alloy made in accordance with the present invention.

One can see the dramatic reduction in the size of the Si and Fe-containing phases.

There was a reduction in the size of $(Fe\ Cr\ Mn)_xSi_yAl_z$ phases, as well as an improvement in their shape—it become more rounded, less needle-shaped. The new form corresponds to improved alloy properties.

Various other embodiments of the present invention are possible. For example, it is possible to use aluminum nitride AlN in lieu of the TiN detailed above, with similar results. The AlN should preferably be in ultrafine powder form, of size 0.02 to 0.08 micron, and should preferably be added according to the above detailed methods.

In other experiments, a quantity of between about 0.01% and 1% of powder by weight was added, with good results.

It is possible to add several types of powder, for example three or four types. The powder may be formed into a cube, for example, with sintering or without it. The cube may include a powder like TiN, together with Cu or Mg and Al. Thus, pre-formed cubes or cylinders or pills may be used, the size according to the quantity of melt to be improved.

The presently disclosed embodiments are to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A process for producing an Al—Si casting alloy, comprising:

heating the alloy to the pouring temperature Tp between liquidus temperature and 750° C., adding a modifier to the melt, the modifier comprising an ultra disperse powder capable of remaining in a solid state during the process for producing the Al—Si casting alloy.

overheating the melt to a second temperature, said second temperature being above a branching temperature of a viscosity or density temperature dependency of said melt as obtained at heating from liquidus up to 1100° C. and subsequent cooling, maintaining the melt at the second temperature for between about 20 and 30 minutes, cooling the melt down to the pouring temperature Tp between liquidus temperature and 750° C., performing at least one of the steps of degassing and fluxing the alloy, and pouring the melt.

2. A process for producing a Al—Si casting alloy, comprising:

heating an alloy to a pouring temperature Tp between liquidus temperature and 750° C., overheating the melt to a second temperature, said second temperature being above a branching temperature of a viscosity or density temperature dependency of said melt as obtained at heating from liquidus up to 1100° C. and subsequent cooling.

maintaining the melt at the second temperature for between about 20 and 30 minutes, cooling the melt down to the pouring temperature Tp between the liquidus temperature and 750° C., performing at least one of the steps of degassing and fluxing the alloy, adding a modifier to the melt, the modifier comprising an ultra disperse powder capable of remaining in a solid state during the process for producing the Al—Si casting alloy, and pouring the melt.

3. A process for producing an Al—Si alloy, comprising:

heating an alloy to a pouring temperature Tp between liquidus temperature and 750° C.;

overheating the melt to a second temperature, said second temperature being above a branching temperature of a viscosity or density temperature dependency of said melt as obtained at heating from liquidus up to 1100° C. and subsequent cooling.

maintaining the melt at the second temperature for between about 20 and 30 minutes, cooling the melt down to the pouring temperature Tp between the liquidus temperature and 750° C., performing at least one of the steps of degassing and fluxing the alloy; and pouring the melt.

4. The process of claim 3, comprising:

continuously mixing the melt for about 3 minutes after adding a modifier to the melt.

5. A process for producing an Al—Si casting alloy, comprising:

heating an alloy to a pouring temperature Tp between liquidus temperature and 750° C., adding a modifier to the melt, the modifier comprising an ultra disperse powder capable of remaining in a solid state during the process for producing the Al—Si casting alloy, performing at least one of the steps of degassing and fluxing the alloy, and pouring the melt, wherein the step of adding a modifier to the melt comprises the step of adding a master alloy to the melt, and wherein the modifier is included within the master alloy, and wherein the master alloys comprise about x % of TiN powder, with the rest Al, and wherein x is in the range of about 3 to 9%.

6. A process for producing an Al—Si casting alloy, comprising:

heating an alloy to a pouring temperature Tp between liquidus temperature and 750° C., adding a modifier to the melt, the modifier comprising an ultra disperse powder capable of remaining in a solid state during the process for producing the Al—Si casting alloy, performing at least one of the steps of degassing and fluxing the alloy, and pouring the melt, wherein the step of performing at least one of the steps of degassing and fluxing the alloy comprises the step of mixing with the aid of Ar degassing, and wherein the step of performing at least one of the steps of degassing and fluxing the alloy is performed in an induction furnace, and wherein induction aids the mixing step.

7. A process for producing an Al—Si casting alloy, comprising:

heating an alloy to a heating an alloy to a pouring temperature Tp between liquidus temperature and 750° C. to produce a melt, overheating the melt to a second temperature, said second temperature being above a branching temperature of a viscosity or density temperature dependency of said melt as obtained at heating from liquidus up to 1100° C. and subsequent cooling.

maintaining the melt at the second temperature for between about 20 and 30 minutes, cooling the melt down to the pouring temperature Tp, treating the melt with ultrasound for not less than about one minute, performing at least one of the steps of degassing and fluxing the alloy, and pouring the melt.

8. A process for producing an Al—Si casting alloy, comprising:

heating an alloy to a pouring temperature Tp between liquidus temperature and 750° C., treating the melt with ultrasound for not less than about one minute, overheating the melt to a second temperature, said second temperature being above a branching temperature of a viscosity or density temperature dependency of said melt as obtained at heating from liquidus up to 1100° C. and subsequent cooling, maintaining the melt at the second temperature for between about 20 and 30 minutes, cooling the melt down to the pouring temperature Tp, performing at least one of the steps of degassing and fluxing the alloy, and pouring the melt.

* * * * *